US007165518B2

(12) United States Patent
Ervin et al.

(10) Patent No.: US 7,165,518 B2
(45) Date of Patent: Jan. 23, 2007

(54) ADJUSTING VALVE LASH FOR AN ENGINE WITH ELECTRICALLY ACTUATED VALVES

(75) Inventors: James D. Ervin, Novi, MI (US); Thomas W. Megli, Dearborn, MI (US); Donald J. Lewis, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/047,462

(22) Filed: Feb. 1, 2005

(65) Prior Publication Data

US 2006/0169229 A1 Aug. 3, 2006

(51) Int. Cl.
*F01L 9/04* (2006.01)

(52) U.S. Cl. ..... 123/90.11; 123/90.15; 123/90.24; 251/129.16; 251/129.18; 251/129.07; 251/129.06; 701/105; 701/111

(58) Field of Classification Search ..... 123/90.11; 701/111; 251/129.06, 129.07
See application file for complete search history.

(56) References Cited

U.S. PATENT DOCUMENTS 5,636,601 A * 6/1997 Moriya et al. ..... 123/90.11
5,711,259 A * 1/1998 Pischinger et al. ..... 123/90.11
5,868,108 A 2/1999 Schmitz et al.
6,427,971 B1 8/2002 Kawabe et al.
6,476,599 B1 * 11/2002 Czimmek et al. ..... 324/207.16
6,810,841 B1 * 11/2004 Peterson et al. ..... 123/90.11
6,938,591 B1 * 9/2005 Fuwa et al. ..... 123/90.11

FOREIGN PATENT DOCUMENTS

| | | |
|---|---|---|
| DE | 10136497 A1 | 7/2001 |
| EP | 870905 | 10/1998 |
| FR | 2851367 | 8/2004 |

OTHER PUBLICATIONS

Abstract, "PSA Peugeot Citroen EVE Concept: Additional Improvement of Potential and Major Breakthrough in NVH Area", Morin et al., pp. 261-289.

* cited by examiner

*Primary Examiner*—Thomas Denion
*Assistant Examiner*—Kyle M. Riddle
(74) *Attorney, Agent, or Firm*—Donald J. Lewis; Allan J. Lippa

(57) ABSTRACT

A system and method for controlling electromechanical valves operating in an engine is presented. According to the method, armature levitation position may be changed to accommodate varying rates of valve stem growth. The method may reduce valve noise during a wide range of engine operating conditions.

20 Claims, 12 Drawing Sheets

ADJUSTING VALVE LASH FOR AN ENGINE WITH ELECTRICALLY ACTUATED VALVES

FIELD

The present description relates to a method for controlling electrically actuated valves operating in a cylinder of an internal combustion engine.

BACKGROUND

One method to control intake and exhaust valve operation during engine operation is described in French Patent application No. FR2851367 A1. This method presents a means to control electromagnetically actuated valves to reduce valve noise. The approach attempts to maintain a valve actuator armature plate at a distance between a coil magnetic pole face and the armature\valve neutral position (sometimes referred to as "levitation") and thereby reduce impacts between the valve armature and the coil magnetic pole face. The approach also mentions using levitation to keep a small clearance (gap) between the valve actuator armature and a valve stem, which may further reduce valvetrain noise since the armature has less time to accelerate before impacting the valve stem during a valve opening operation.

The above-mentioned method can also have a disadvantage due to temperature effects on valve stem length, for example. During lower temperature operation, the valve stem length can decrease, thereby increasing any clearance gap between the valve actuator armature and the valve stem. This increase in the clearance gap can increase the velocity at contact, thereby increasing noise. Likewise, during higher temperature engine operation, the clearance gap can be inadvertently eliminated. This decrease in the clearance gap can result in incomplete valve seating and cylinder leakage into the intake and/or exhaust manifolds.

The inventors herein have recognized the above-mentioned disadvantages and have developed a system and method of electromechanical valve control that offers substantial improvements.

SUMMARY

One embodiment of the present description includes a method to control the position of a valve actuator armature, with respect to a valve stem, for an electrically actuated valve, said electrically actuated valve operating in a cylinder of an internal combustion engine, the method comprising: positioning said valve actuator armature such that said armature is not in contact with a magnetic pole face while controlling a gap between said armature and said valve stem; and varying said valve armature position during subsequent cylinder cycles.

In this way, in one example, it is possible to obtain an appropriate gap over a range of termperaures by varying the armature position. In other words, reduced valve noise over a range of temperatures can be obtained by compensating for changes in valve stem length, while reducing potential gas leakage.

Further, in another example, it may be possible to reduce fuel consumption. In other words, the gap distance that reduces noise at low temperatures may be larger than the gap size that reduces noise at high temperatures. And since larger gaps may require more energy, by varying the clearance gap as conditions vary, it may be possible to reduce fuel consumption. At the same time, acceptable noise levels can be provided.

In still another example, the gap may be adjusted, based on engine operating conditions, so that valve noise, cylinder leaks, and fuel consumption are reduced. In addition, changing the gap based on engine operating conditions can also allow engine designers to exchange fuel consumption for valve noise or vice-versa, at least within some limits.

The present description may provide several advantages. Specifically, the approach may be used to reduce valve noise while maintaining a cylinder seal during a variety of engine operating conditions and manufacturing tolerances. In addition, fuel consumptions may be reduced, at least during some conditions, while valve impact noise may be reduced.

The above advantages and other advantages, and features of the present description will be readily apparent from the following Detailed Description when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

Figure 1:
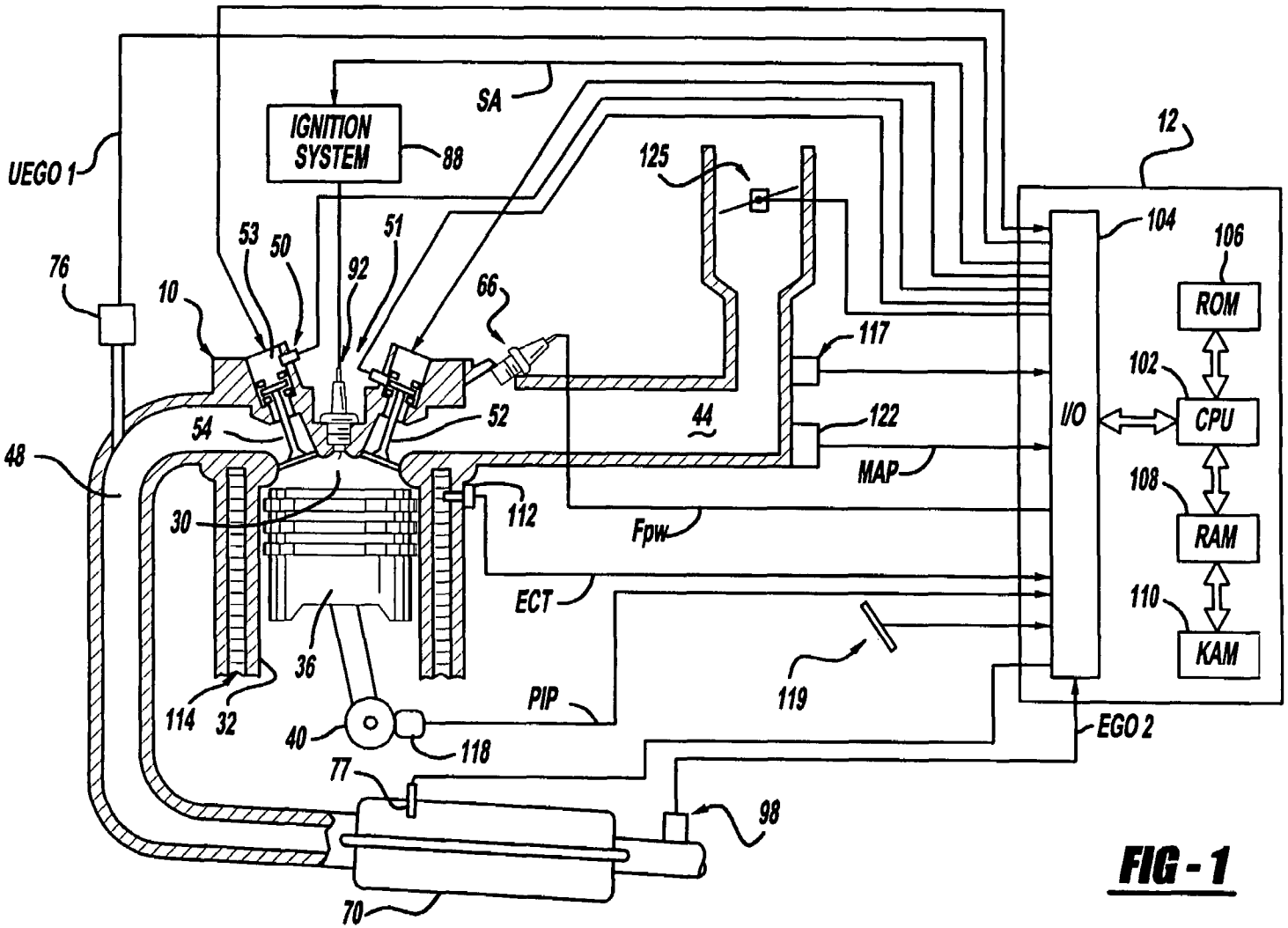
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 an exhaust valve 54. Each intake and exhaust valve is operated by an electromechanically controlled valve coil and armature assembly 53. Armature temperature is determined by temperature sensor 51. Valve position is determined by position sensor 50. In an alternative example, each valves actuator for valves 52 and 54 has a position sensor and a temperature sensor. In yet another alternative example, armature temperature may be determined from actuator power consumption since resistive losses can scale with temperature.

Intake manifold 44 is also shown having fuel injector 66 coupled thereto for delivering liquid fuel in proportion to the pulse width of signal FPW from controller 12. Fuel is delivered to fuel injector 66 by fuel system (not shown) including a fuel tank, fuel pump, and fuel rail (not shown). Alternatively, the engine may be configured such that the fuel is injected directly into the engine cylinder, which is known to those skilled in the art as direct injection. In addition, intake manifold 44 is shown communicating with optional electronic throttle 125.

Distributorless ignition system 88 provides ignition spark to combustion chamber 30 via spark plug 92 in response to controller 12. Universal Exhaust Gas Oxygen (UEGO) sensor 76 is shown coupled to exhaust manifold 48 upstream of catalytic converter 70. Alternatively, a two-state exhaust gas oxygen sensor may be substituted for UEGO sensor 76. Two-state exhaust gas oxygen sensor 98 is shown coupled to exhaust manifold 48 downstream of catalytic converter 70. Alternatively, sensor 98 can also be a UEGO sensor. Catalytic converter temperature is measured by temperature sensor 77, and/or estimated based on operating conditions such as engine speed, load, air temperature, engine temperature, and/or airflow, or combinations thereof.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, and read-only-memory 106, random-access-memory 108, 110 Keep-alive-memory, and a conventional data bus. Controller 12 is shown receiving various signals from sensors coupled to engine 10, in addition to those signals previously discussed, including: engine coolant temperature (ECT) from temperature sensor 112 coupled to water jacket 114; a position sensor 119 coupled to a accelerator pedal; a measurement of engine manifold pressure (MAP) from pressure sensor 122 coupled to intake manifold 44; a measurement (ACT) of engine air amount temperature or manifold temperature from temperature sensor 117; and a engine position sensor from a Hall effect sensor 118 sensing crankshaft 40 position. In a preferred aspect of the present description, engine position sensor 118 produces a predetermined number of equally spaced pulses every revolution of the crankshaft from which engine speed (RPM) can be determined.

In an alternative embodiment, a direct injection type engine can be used where injector 66 is positioned in combustion chamber 30, either in the cylinder head similar to spark plug 92, or on the side of the combustion chamber.

Figure 2:
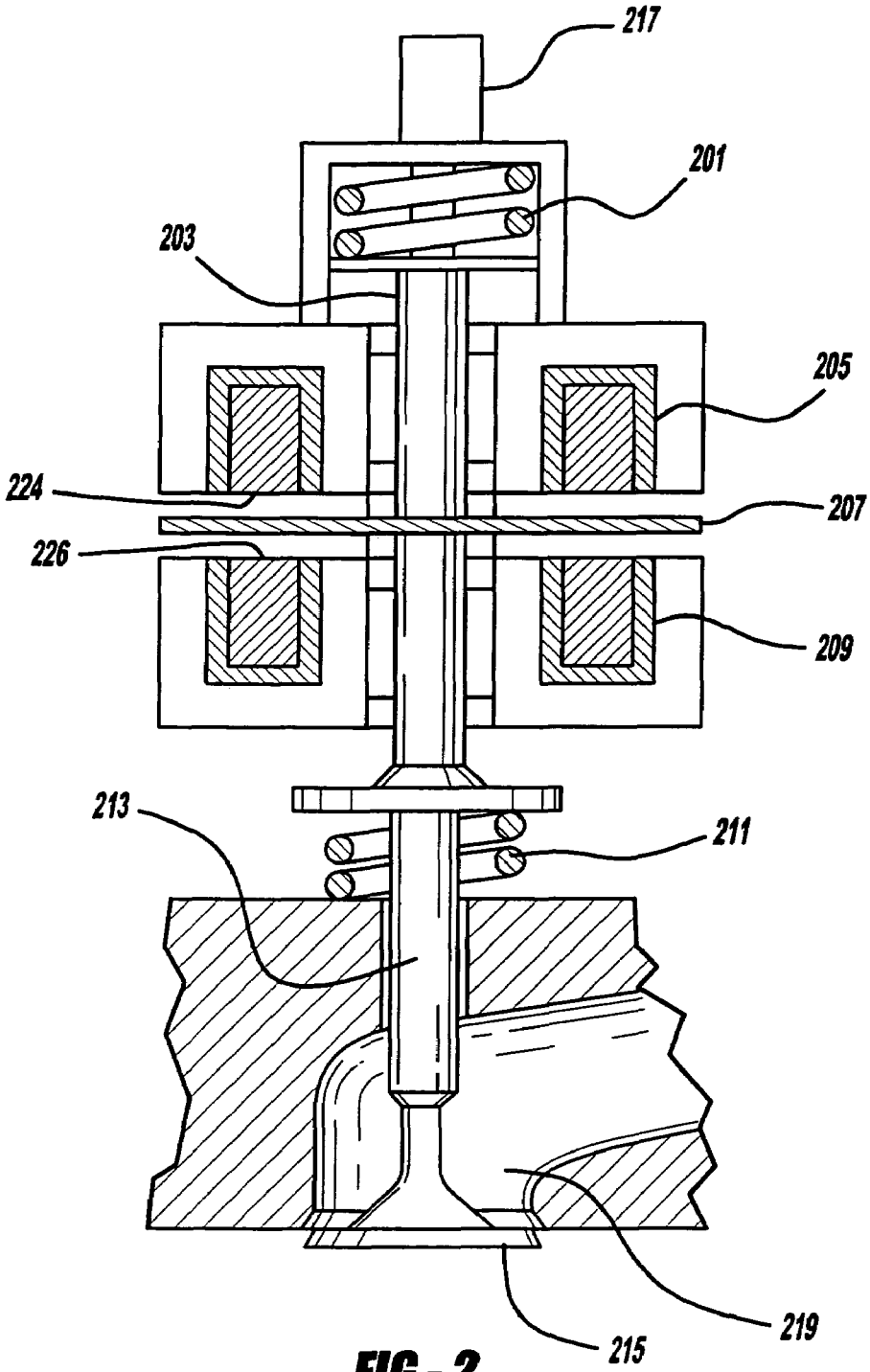
FIG. 2 is a schematic diagram that shows an electrically actuated valve in a neutral state.

Referring to FIG. 2, a schematic of an example electrically actuated valve is shown. The valve actuator is shown in a de-energized state (i.e., no electrical current is being supplied to the valve actuator coils). The electromechanical valve is comprised of an armature assembly and a valve assembly. The armature assembly is comprised of an armature return spring 201, a valve closing coil 205, a valve opening coil 209, an armature plate 207, a valve displacement transducer 217, and an armature stem 203. When the valve coils are not energized the armature return spring 201 opposes the valve return spring 211, valve stem 213 and armature stem 203 are in contact with one another, and the armature plate 207 is essentially centered between opening coil 209 and closing coil 205. This allows the valve head 215 to assume a partially open state with respect to the port 219. When the armature is in the fully open position the armature plate 207 is in contact with the opening coil magnetic pole face 226. When the armature is in the fully closed position the armature plate 207 is in contact with the closing coil magnetic pole face 224.

Figure 3:
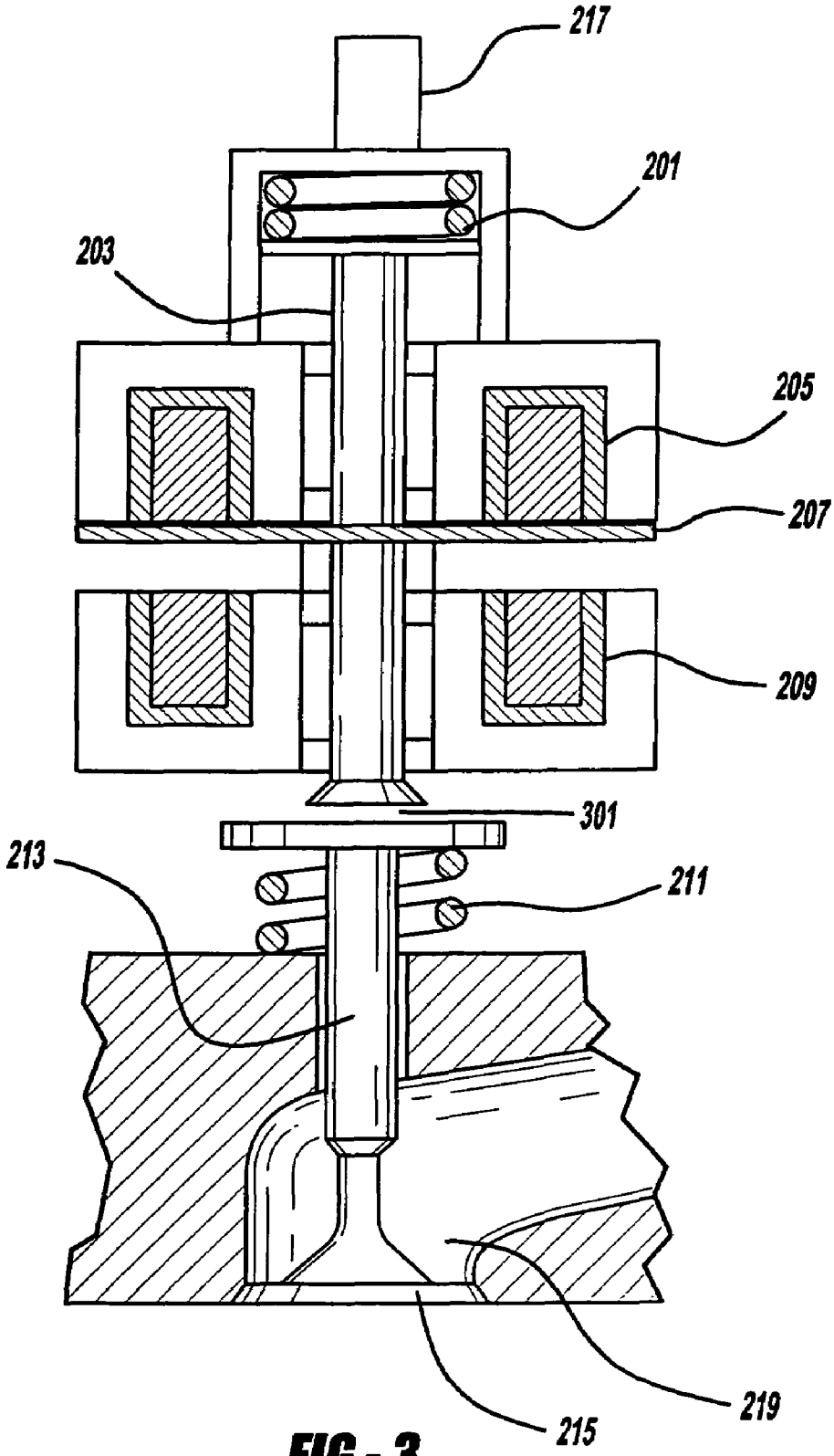
FIG. 3 is a schematic diagram that shows an electrically actuated valve in a closed state.

Referring to FIG. 3, a schematic of an electrically actuated valve commanded to a closed position is shown. The back of valve head 215 is shown in contact with the valve seat of port 219. This restricts flow between the cylinder 30 and the intake manifold 44 or the exhaust manifold 48. The actuator armature 203 is shown moved away from the valve stem 213, resulting from an electromagnetic force generated by closing magnet 205 acting on armature plate 207. In one example, the gap 301 between the valve stem 213 and the armature stem 203 may be an intentionally set gap, set when the engine is cold, that allows the valve to close if engine temperature causes the valve stem to grow toward the actuator armature. Note: Exhaust valve lash may decrease with temperature and intake valve lash may increase with temperature, but enough of a lash margin may be provided so that some lash is ensured throughout the operating range of the engine. This gap is referred to as the valve lash and it is typically between 0.2 and 0.35 millimeters. The attraction of armature coil 205 to the armature plate 207 pulls the armature plate 207 into contact with the armature coil 205 at the magnetic pole face. The movement of armature plate 207 toward coil 205 also compresses armature return spring 201.

Figure 4:
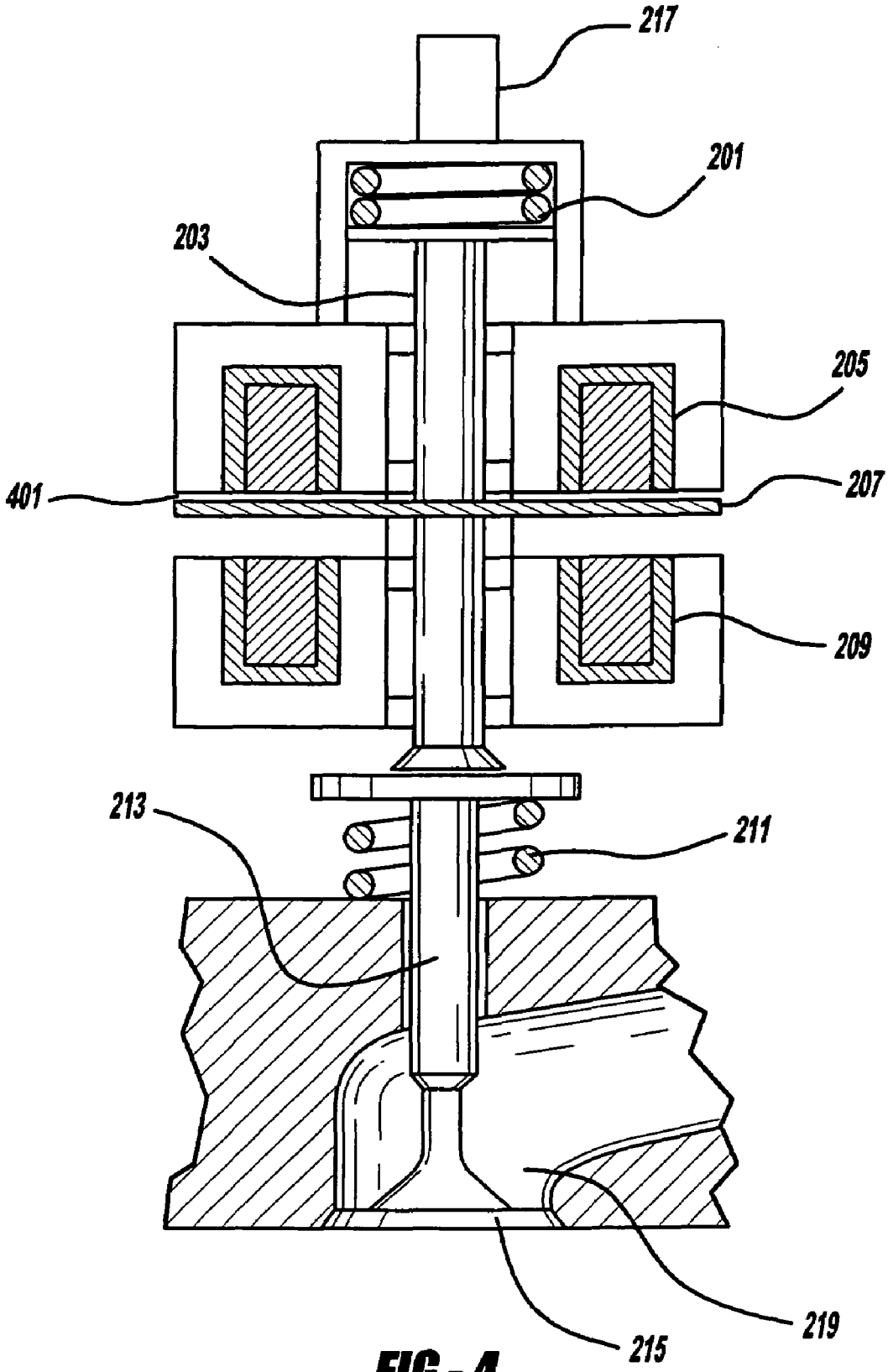
FIG. 4 is a schematic diagram that shows an electrically actuated valve in a levitation state.

Referring to FIG. 4, a schematic of an electrically actuated valve commanded to a levitated position is shown. The back of the valve head 215 is shown in contact with the valve seat of port 219. Again, this restricts flow between the cylinder 30 and the intake manifold 44 or the exhaust manifold 48. The actuator armature 203 is shown in close proximity to the valve stem 213. During levitation, the armature coil provides an equal and opposite force to the armature return spring 201 such that the armature stem may be in close proximity to the valve stem 213, including the condition where the armature stem is in contact with the valve stem. Furthermore, the electromagnetic force may be adjusted so that the gap space may be adjusted. Conversely, the valve may be held open in a levitated state as well. In this example, the armature plate can be held away from opening coil 209 such that the valve may be nearly completely open and such that contact with the opening coil may be avoided.

Figure 5:
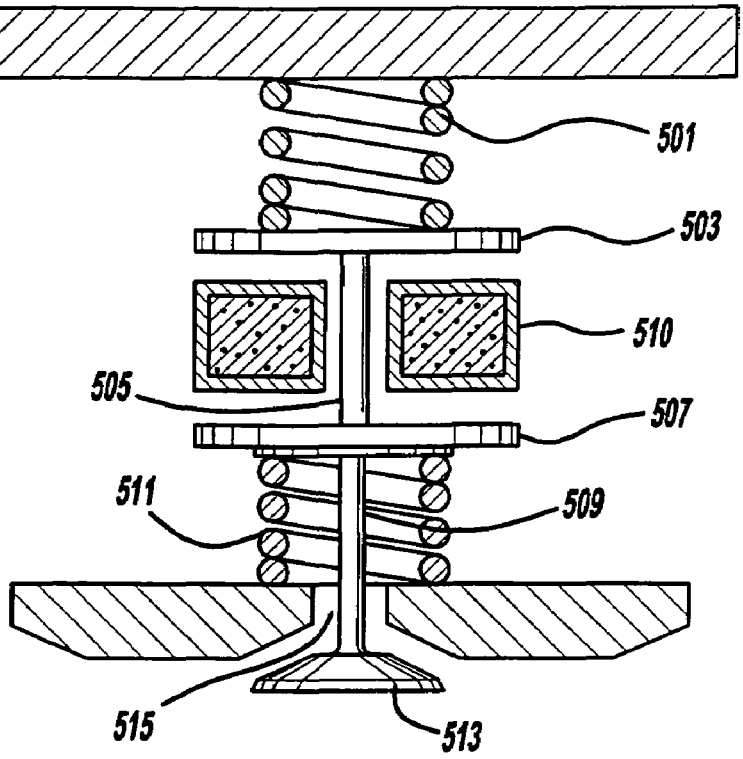
FIG. 5 is a schematic of an alternate electromechanically actuated valve in a neutral state.

Referring to FIG. 5, a schematic of an alternate example of an electrically actuated valve is shown. The valve actuator is shown in a de-energized state (i.e., no electrical current is being supplied to the valve). The electromechanical valve is comprised of an armature assembly and a valve assembly. The armature assembly is comprised of an armature return spring 501, a coil 510, an armature opening plate 503, an armature closing plate 507, and an armature stem 505. When the valve armature is not energized the armature return spring 501 opposes the valve return spring 511, valve stem 509 and armature stem 505 are in contact with one another, and armature plates 503 and 507 are centered about coil 510. This allows the valve head 513 to assume a partially open state with respect to the port 515.

Figure 6:
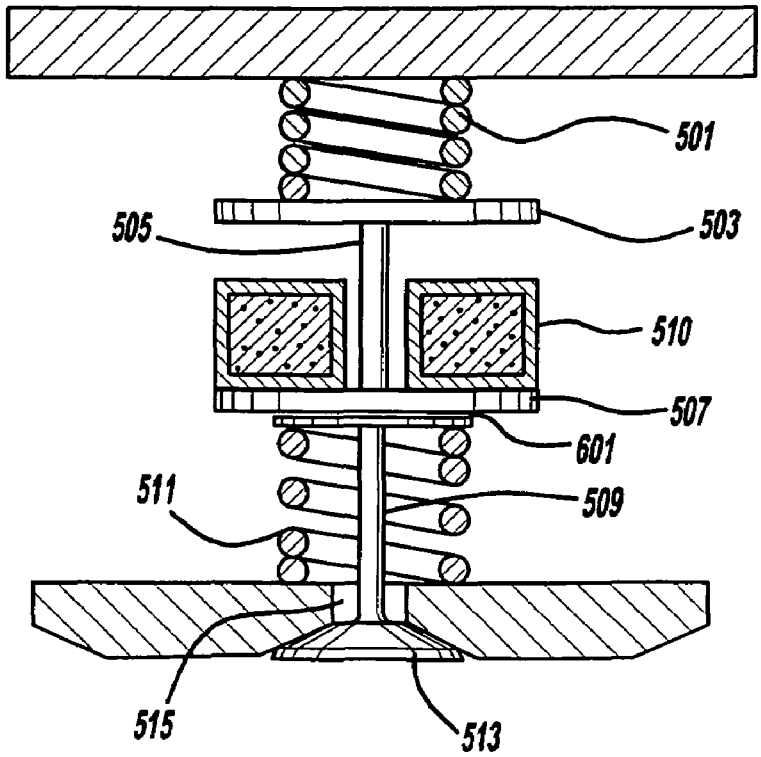
FIG. 6 is a schematic diagram that shows an alternative electrically actuated valve in a closed state.

Referring to FIG. 6, a schematic of an electrically actuated valve commanded to a closed position is shown. The back of valve head 513 is shown in contact with the valve seat of port 515. This restricts flow between the cylinder 30 and the intake manifold 44 or the exhaust manifold 48. The actuator armature 505 is shown separated from the valve stem 509, resulting from an electromagnetic force generated by magnet 510 acting on armature plate 507. Similar to gap 301, gap 601 is an intentionally set gap that provides valve lash. The attraction of armature coil 510 to the armature plate 507 pulls the armature plate 507 into contact with the armature coil 510. The movement of armature plate 507 toward coil 510 also compresses armature return spring 501.

Figure 7:
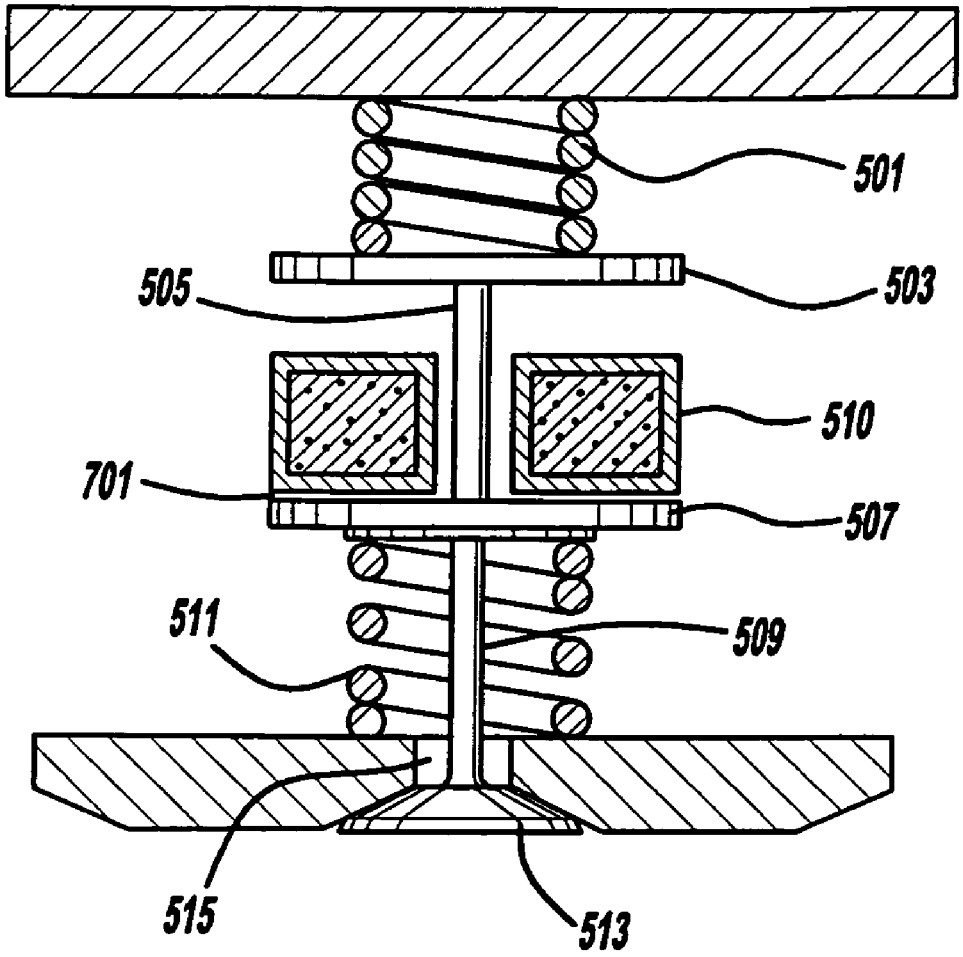
FIG. 7 is a schematic diagram that shows an electrically actuated valve in a levitation state.

Referring to FIG. 7, a schematic of an electrically actuated valve that is commanded to a levitated position is shown. The back of the valve head 513 is shown in contact with the valve seat of port 515. Again, this restricts flow between the cylinder 30 and the intake manifold 44 or the exhaust manifold 48. The actuator armature 505 is shown in close proximity to the valve stem 509. During levitation, the armature coil provides an equal and opposite force to the armature return spring 511 such that the armature stem may be in close proximity to the valve stem 505, exposing gap 701. Conversely, the valve may be held open in a levitated state as well. In this example, the armature plate can be held away from coil 510 such that the valve may be nearly completely open and such that contact with the coil may be avoided.

Note: Armature plates 207, 503, and 507 may have planar permanent magnets attached to them in order to reduce opening and closing current. In addition, a permanent magnet can make the attracting and repulsing forces between an armature plate and a coil more linear. Alternatively, the armature plates may be constructed of a ferrous metal or alloy. In addition, the electromechanical valves may be configured as exhaust or intake valves. Furthermore, the actuator cores may also have permanent magnets inserted to modify the magnetic force characteristics of the actuator.

Figure 8:
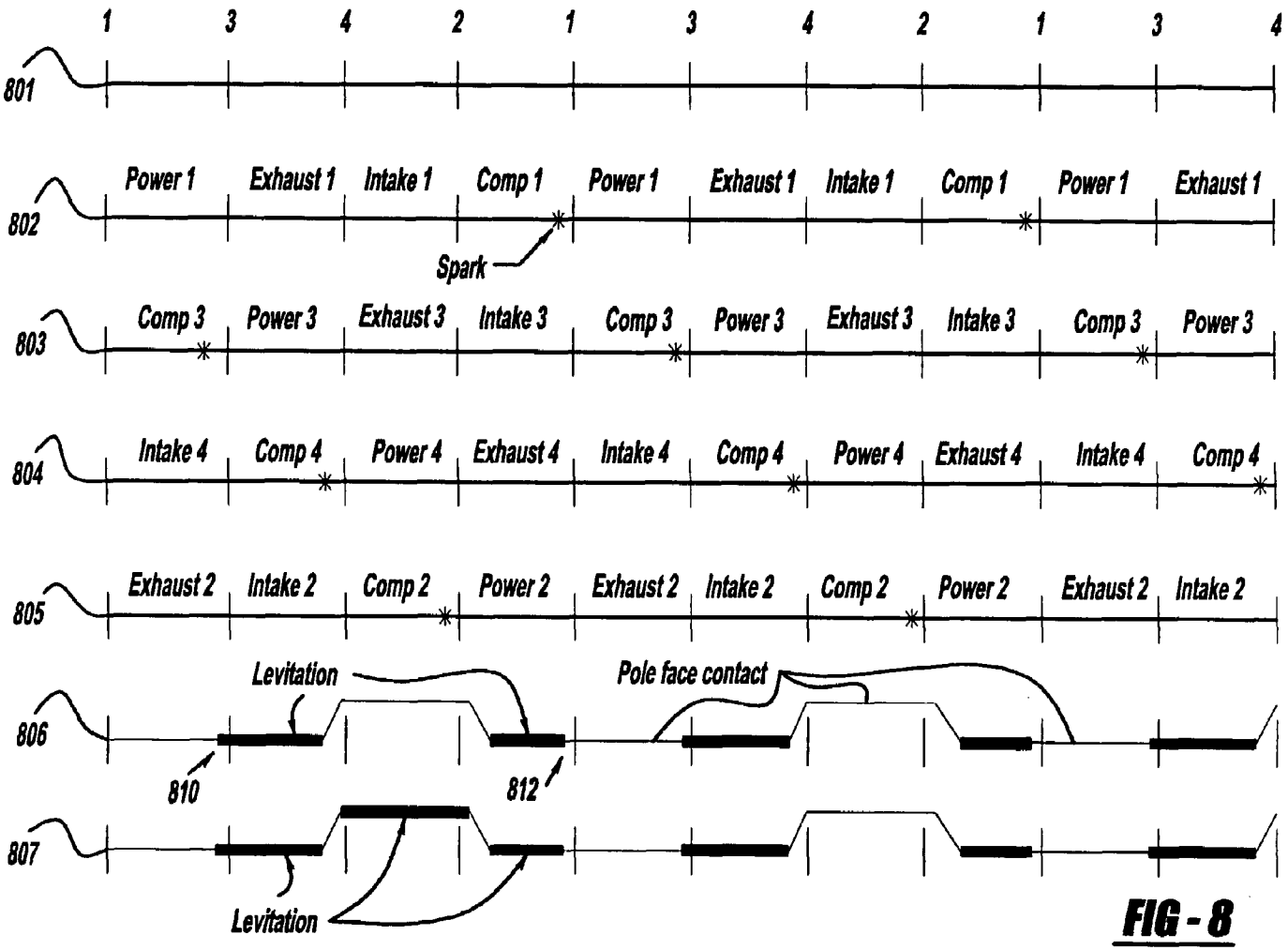
FIG. 8 is a schematic diagram that shows an example of valve operating states as they may related to engine position.

Referring to FIG. 8, a schematic is shown of an example valve operation using a levitation strategy during the cycle of a cylinder. Engine combustion timing is shown by the sequence illustrated by time line 801. For simplicity, the sequence shows combustion timing for a four cylinder, four-cycle engine, with a firing order of 1-3-4-2. However, the method illustrated is applicable for multi-stroke engines, variable displacement engines, as well as six, eight, ten, and twelve cylinder engines. As such, the illustration is not meant to limit the description in any way. Furthermore, the greater the number of cylinders in an engine, the less time is necessary for the valves to operate in levitation mode because opportunities to enter or exit levitation mode occur more frequently. For example, a four cylinder four cycle engine combusts an air-fuel mixture every 180 crank angle degrees and an eight cylinder four cycle engine combusts an air-fuel mixture every 90 crank angle degrees. This allows a combustion event in a four cylinder engine to mask a valve event every 180 crank angle degrees while combustion in an eight cylinder engine can mask a valve event every 90 crank angle degrees. Therefore, during some conditions, up to an additional 180 crank angle degrees of valve levitation per valve may be eliminated during a cycle of a cylinder for an eight cylinder engine when compared to a four cylinder engine.

Continuing with FIG. 8, cylinder strokes based on the order of combustion for each of the respective cylinders are illustrated by 802, 803, 804, and 805. It can be seen that the cylinder stroke of one cylinder overlaps the stroke of another cylinder, albeit the cylinder strokes are different. For example, the compression stroke of cylinder 1 corresponds to the intake stroke of cylinder 3, the exhaust stroke of cylinder 4, and the power stroke of cylinder 2. The inventors herein have recognized that cylinder events that may occur during a particular cylinder stroke of one cylinder may be used to disguise or mask an event in another cylinder that is on different stroke. Namely, the noise from a combustion event in one cylinder may be used to reduce the perception of valve opening or closing noise in another cylinder. Further, by levitating the actuator armature for only a portion of the valve opening and/or closing duration, power to operate valves may be reduced. Cylinder spark events are denoted in the figure by an * in the respective cylinder timing cycles.

Sequence 806 illustrates one example of intake valve control that may be used to lower valve noise and reduce valve power consumption. Specifically, intake valve timing for cylinder number one is shown. During a portion of the power stroke and a portion of the compression stroke, the intake valve is held in the closed position and the actuator armature is in contact with a magnetic coil pole face, denoted by the thin line. The figure shows that the armature of an intake valve for cylinder one begins to levitate 810 at a location substantially coincident with a spark event in cylinder number three of the engine. Alternatively, the valve may be levitated at a predetermined point that may or may not correspond to another event in another cylinder of the engine, a location of peak cylinder pressure, a valve timing condition of another valve, or a location of fuel injection, for example. The armature is levitated for a predetermined duration and then the valve is opened by moving the armature away from the closing coil. The armature contacts the opening coil and remains in contact with the opening coil until the valve close command is issued. The valve is closed and the armature is held in levitation until another predetermined engine position is reached 812, then the armature is moved into contact with the magnetic pole face of the closing coil. The figure shows the cessation of levitation 812 substantially coincident with the spark location of cylinder one, see element 802. In this way, less levitation operation may be used (which can save power), and valve noise that may be produced at the end of levitation can be masked by combustion noise in other cylinders.

The timing of the armature levitation and valve events are expected to vary based on engine operating conditions and the structure of the valve control system. As such, the valve and armature levitation duration may be engine position based, time based, or based on other engine related variables, such as engine temperature for example, or combinations of these and/or other variables. Further, the illustrations of FIG. 8 depict intake valve timing, but the method may be appropriate for exhaust valve control as well. Further, such an approach may be used on a subset or group of intake and/or exhaust valves, if desired.

Sequence 807 illustrates an alternative intake valve control strategy. The valve control is identical to that shown in sequence 806 with the exception that the intake valve is levitated while the valve is open. That is, the armature approaches the valve opening magnetic coil pole face but remains a small distance away from the pole face during the valve opening event. This sequence may further reduce valve noise since impact between the armature and the opening coil may be avoided, however, armature power consumption may increase.

Figure 9:
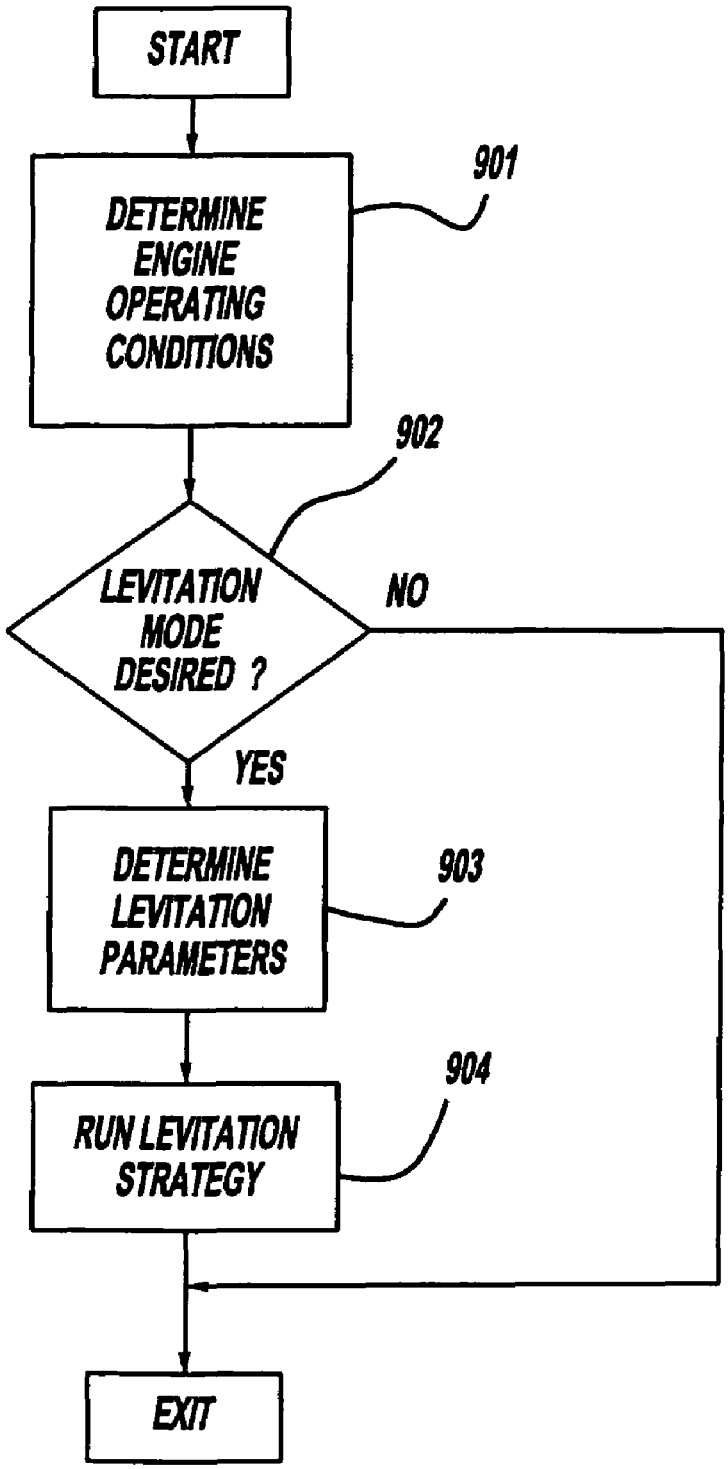
FIG. 9 is a flow diagram showing a valve control strategy for an engine with electrically actuated valves.

Referring to FIG. 9, a flow chart of a valve control strategy is shown.

For multi-cylinder, four-stroke engines, the stroke of individual cylinders (i.e., the specific stroke that a cylinder is on during a cycle of an engine, an intake stroke, for example) often overlaps with a different or common stroke of another cylinder. For example, for a four-stroke, four cylinder engine, the intake stroke of cylinder one coincides with the compression stroke of cylinder two. By aligning valve impact events with combustion events in another cylinder of the engine, for example, perceived valve actuator noise may be reduced since valve noise may be masked by the combustion noise of another cylinder of the engine. In addition, allowing the valve armature plate to come into contact with a coil magnetic pole face can reduce the amount of current used to hold or capture a valve in an open or closed position. Consequently, a valve armature plate may be held in contact with a coil magnetic pole face for a portion of a closed valve interval, then moved to a position that reduces or eliminates space or gap (lash) between a valve actuator armature and the valve stem. After the valve has been levitated for a desired period the valve actuator armature can be moved to an opposing coil magnetic pole face (where the valve is open), then the valve armature plate can be returned to a levitation position (where the intake valve is closed), after the valve has been levitated for a desired period the armature can then be returned to the first coil magnetic pole face. As a result, this method may reduce valve noise while improving fuel economy. In addition, less current may be used by the valve actuator coil over a cycle of a cylinder so that the coil temperature rise from current passing through the coil may be lower. As a consequence, temperature based valve actuator degradation may also be lowered. In one embodiment, these advantages and benefits may be obtained by programming engine controller 12 to select between levitation and non-levitation modes as engine operating conditions vary.

Continuing with FIG. 9, in step 901, engine and valve operating conditions are determined. Specifically, engine coolant temperature, engine speed, engine load, power supply conditions (voltage, current, and/or battery state), and/or valve actuator conditions (temperature, voltage, and/or current) are determined by interrogating the various sensors described in FIG. 1. The routine then proceeds to step 902.

In step 902, a decision to levitate or to not levitate valves is made. As noted above, in an alternate embodiment, a decision for each valve may be independently determined, so that levitation is used for some valves, and not others, during selected engine operating conditions.

The following expressions are an example of some conditions that may be used to determine when actuator armature levitation is permitted:

If (lev_eng_tmp_lo<eng_temp<lev_eng_tmp_hi)

If (lev_vlv_tmp_lo<vlv_temp<lev_vlv_tmp_hi)

If (lev_vbatt_lo<vbatt<lev_vbatt_hi)

If (lev_eng_ld_lo<eng_ld<lev_eng_ld_hi)

If (lev_eng_n_lo<eng_n<lev_eng_n_hi)

Where the lev_eng_tmp_lo parameter corresponds to a predetermined lower engine temperature limit for levitation, eng_tmp is the current engine temperature, lev_eng_tmp_hi is a upper engine temperature limit for levitation, lev_vlv_tmp_lo is a lower valve actuator temperature limit for levitation, vlv_temp is the current valve armature temperature, lev_vlv_tmp_hi is a upper valve actuator temperature limit for levitation, lev_vbatt_lo is a lower battery voltage limit for levitation, vbatt is battery voltage, lev_vbatt_hi is a upper battery voltage limit for levitation, lev_eng_ld_lo is a lower engine load limit for levitation, eng_ld is engine load, lev_eng_ld_hi is a upper engine load limit for levitation, lev_eng_n_lo is a lower engine speed limit for levitation, eng_n is engine speed, and lev_eng_n_hi is a upper engine speed limit for levitation. In this way, electrical system conditions and engine operating conditions may be used to determine whether to enter levitation mode.

In this example, each logic statement is checked to see if the conditions are true. If all of the statements are true the valve actuators enter levitation mode by proceeding to step 903, otherwise the routine exits. In an alternative embodiment, alternative conditions may be used, such as a subset of the above conditions.

In step 903, parameters used to control armature levitation are determined. Specifically, the start of levitation location, valve opening location and duration, stop of levitation, armature levitation position during closed valve, and armature levitation position during open valve are determined. Note that these are exemplary parameters that may be used, and various other parameters may be used, if desired.

One method to determine the starting location for a specific valve scheduled to be levitated can be to use the location of spark, or of another cylinder event based parameter (e.g., location of peak cylinder pressure), in a cylinder of the engine. For example, the intake valve timing of FIG. 8, element 806, shows cylinder 1 intake valve beginning to levitate 810 at the location of spark in cylinder 3, see element 803. The end of levitation 812 for this cylinder cycle corresponds to the location of spark in cylinder 1, see element 802. Alternatively, parameters (e.g., engine coolant temperature, valve temperature, engine speed, engine load, valve timing, fuel injection timing, ambient air temperature, and time since engine start) may be used to index functions or tables that contain empirical or calculated locations that correspond to desired locations of where to begin and end levitation during a cycle of a cylinder.

Another series of tables and functions can be indexed based on engine operating conditions to gather empirically determined values for armature levitation position during closed valve and/or open valve operation. In one example, a table indexed by an engine temperature (e.g., valve temperature, armature temperature, coolant temperature, or cylinder head temperature) and time since start may be used to determine a desirable armature levitation position. In another example, a table may be indexed by the number of cylinder combustion events and by the power supply voltage to determine a desired levitation position. Alternatively, the method described by FIG. 10*a*, or alternatively FIG. 10*b*, may be used solely or in combination with the previously mentioned method to determine levitation position.

Since both intake and exhaust valve timing can affect the desired cylinder air charge, the valve opening duration may be determined by any one of a number of methods used to determine valve timing in an engine with electromechanical valves, such as that described in U.S. patent application Ser. No. 10/805642, which is hereby fully incorporated by reference. The routine continues to step 904.

In step 904, commands are issued to the valve controller to operate selected valves in levitation mode. Each cylinder scheduled for levitation operation can be sent the levitation parameter information that was determined in step 903 and cylinder cycle based levitation begins in the respective cylinder. Valve commands are updated every cylinder cycle to ensure timely response to driver demands. The routine then proceeds to exit.

Note: The routine of FIG. 9 is not limited to determining levitation mode for all cylinders or valves. In other words, it is not necessary that all cylinders or valves be simultaneously operated in a levitation mode. For example, a fraction of the cylinders (i.e., a group of cylinders) or valve actuators (i.e., a group of valve actuators) may be operated in a levitation mode while the remaining cylinders or valve actuators are in a mode that does not utilize levitation. Furthermore, levitation modes may be exchanged between valve actuators and\or cylinders during different cycles of an engine. For example, a valve in levitation mode during a particular cycle of an engine may be commanded into a mode without levitation while another valve actuator is commanded in an inverse manner. The before-mentioned options can provide additional levels of valve noise control and power consumption regulation.

Figure 10A:
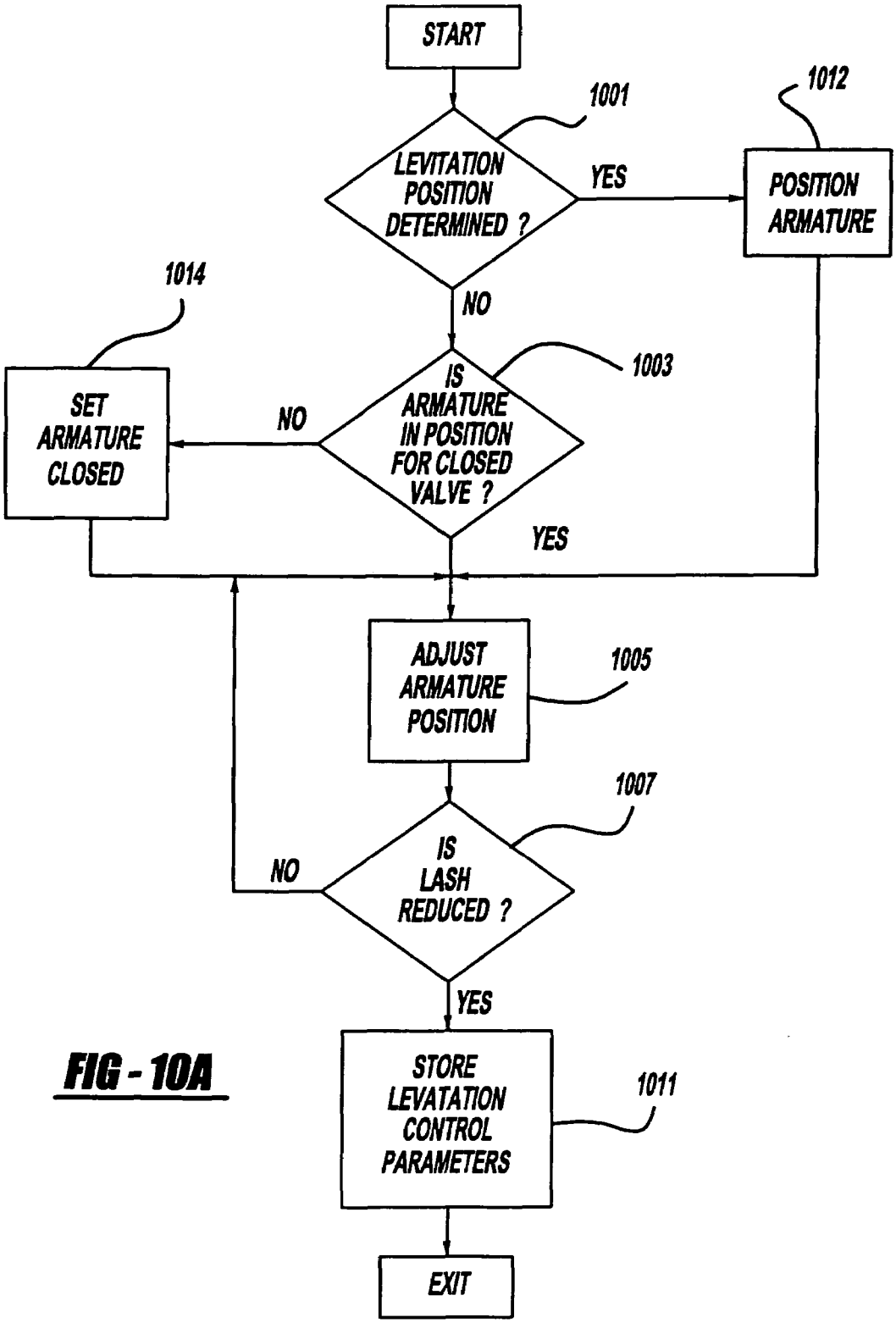
FIG. 10*a* is a flow diagram showing a strategy for adjusting and adapting valve levitation position.

Referring to FIG. 10*a,* a flow chart for a routine to control an electrically actuated valve armature in levitation based on a lash amount between the actuator armature and the valve stem is shown.

Valve stem length can vary during an operating cycle of an engine and compensation for the variation may be desirable. For example, engine temperatures may vary by more than 100° C. in an operating cycle which may lead to expansion of engine components. Specifically, valve stem length can increase as the metal stem expands due to the heat of combustion. During such conditions, it may be desirable to maintain the seating of valves so that leakage into or out of the cylinder is reduced. Typically, a gap (i.e., valve lash) between the valve stem and the component operating on the valve is mechanically established during cold conditions by adjusting components. As the engine temperature increases the gap may be reduced, thereby reducing the valve lash. This may allow the valve to maintain a cylinder seal over a wide range of temperatures, but it may also increase valve noise at lower temperatures since a gap exists between the valve actuator and the valve stem.

The desired position of a valve actuator armature can be adjusted as engine temperature increases or decreases. By observing actuator current and actuator armature position, the location where a valve actuator armature contacts a valve stem may be determined during a variety of engine operating conditions (e.g., by observing engine cylinder head temperature, exhaust temperature, engine coolant temperature, etc.). When a valve actuator armature is moved from a full closed position (against a magnetic pole face) to a position that places the armature in contact with a valve stem, the position of contact may be determined by observing that a certain change in actuator current does not result in a corresponding change in actuator position. Once determined, the contact position can be used to position the valve actuator armature so that armature/valve impact noise and valve leakage are reduced. Further, the actuator armature position can be adjusted as the valve stem length changes. In this way, the desired actuator armature position may be adjusted based on sensor measurements or inferred engine operating conditions.

The effectiveness of levitation to reduce valve noise can be influenced by where the position of armature levitation is set and by the position of the valve stem with respect to that position. When the armature is commanded to the open position it accelerates from its initial position (i.e., the closing coil pole face or levitation position) and increases in velocity until approximately valve mid position. The valve decelerates from that point until the open position is reached. Consequently, the impact noise between the actuator armature and the valve stem, caused by the valve opening command, increases as the distance separating the armature and the valve stem increases. This occurs because increased separation between the armature and the valve stem allows the armature to reach a higher velocity before impacting the valve stem, thereby increasing the impact noise. However, this impact noise may be reduced by moving the armature levitation point closer to the valve stem since doing so reduces the armature/valve separation. The method described by FIG. 10*a* can reduce the armature/valve separation during a variety of engine operating conditions.

Continuing with FIG. 10*a,* in step 1001 the routine determines if an initial levitation position location has been determined. That is, the routine determines if an armature position has been determined that reduces the valve lash between the armature and the valve stem. The lack or presence of stored data, from step 1011, can be used to determine the next step. If a predetermined levitation position is available, the routine proceeds to step 1012, if not, the routine proceeds to step 1003.

In step 1012, armature data from the previous execution of the method of FIG. 10*a* is recalled from memory and the armature is controlled to this position. This recalled data allows the control routine to pre-position the armature. The armature can be commanded to a position based on the retrieved data by a position controller of the form:

$$\text{Coil_cur}(k)=\text{ftn_ff}(\text{basis_offset})+K_1(e_{pos}(k))+K_2\Sigma e_{pos}(k) \quad (1)$$

Where Coil_cur(k) is the commanded coil current, ftn_ff is a feed forward table look-up that provides armature coil current as a function of armature position (basis_offset), $K_1$ is a constant that is based on sample time and a predetermined current gain, alternatively $K_1$ can vary as a function of other variables (e.g., engine temperature, armature location, magnitude of the error signal, etc.), $e_{pos}(k)$ is the armature position error at sample k, $K_2$ is a constant that is based on sample time and a predetermined current gain, alternatively $K_2$ can vary as a function of other variables (e.g., engine temperature, armature location, magnitude of the error signal, etc.), and $\Sigma e_{pos}(k)$ is the sum of armature position error at a given commanded position. By initially pre-positioning the armature at the previous zero lash position (i.e., the armature position where the armature contacts the valve stem, when the armature is moved from a position of no contact between the armature and the valve stem to a position where contact occurs between the armature and the valve stem) or at position that is marginally further away from the valve stem (e.g., between 0.15 and 0.005 mm), the number of iterations necessary to remove lash between the armature and the valve stem may be reduced since a large fraction of the lash is removed by pre-positioning the actuator armature. For example, pre-positioning the valve actuator armature based on a previously learned location can be beneficial during an engine start when the exact valve stem location may not be known.

When the armature is commanded to a levitated position from a coil pole face, the desired position is updated which creates an error between the actual armature position and the desired armature position. The position error causes a decrease in the coil current and allows the armature to move away from the pole face and to the desired position. Since more energy is required to levitate the armature away from the pole face, additional current is provided by the feed forward function (ftn_ff). This increased current can be counteracted by the current reduction request provide by the error terms in equation 1. Consequently, to move the coil from a pole face the current is initially decreased and then is increased as the armature approaches the desired position. When the armature is commanded from a levitated position to a nearby pole face the current is increased and then is decreased as the armature approaches the pole face.

In addition, one or more of the error correction terms of equation 1 may restrict control effort unless the armature position error exceeds a fixed or varying limit. In other words, if desired, correction of valve current may be restricted until the valve armature position error exceeds an upper or lower limit. If the error exceeds a correction boundary then valve current adjustments may be made. Furthermore, the amount of valve correction current may be restricted such that current beyond a predetermined high or low current limit may not be commanded. These limits and/or boundaries may be used to keep the control effort within a desired range of acceptability.

In step 1003, armature position is determined. If the armature is not positioned in contact with the valve closing coil the routine proceeds to step 1014. If the armature is positioned in contact with the valve closing coil the routine proceeds to step 1005.

In step 1014, the armature is commanded to the full closed position (i.e., the armature plate is in contact with the closing coil pole face). This location allows the levitation controller to determine a basis position for the armature, which serves as a known position reference for the armature positioning controller.

In step 1005, armature position can be adjusted. Depending on the results of step 1001, step 1014, or step 1012 an initial position for the armature (basis_offset), relative to the basis position can be commanded to the valve. The armature position can be subsequently incremented by a desired amount such that the newly commanded position is in a direction toward the valve stem. The armature position can be regulated by the method of step 1012 or an alternative method, and the armature position can be adjusted by the following equation:

$$basis_offset = basis_offset + inc$$

Where basis_offset is the desired relative position of the armature and where inc is a predetermined or calculated incremental change in desired armature position. The routine then proceeds to step 1007.

During some conditions the commanded armature levitation position can be limited to a predetermined range. By predetermining upper and lower levitation position amounts the control effort may be bounded and undesirable levitation positions may be avoided. In one example, a small amount of levitation may be avoided because it may increase energy consumption without providing a desired level of valve noise reduction. Establishing levitation position boundaries can keep the actuator armature in a desirable operational range.

In step 1007, an assessment of valve lash is made. If the absolute value of the coil current (coil_cur) changes by more than a predetermined amount and the measured armature position changes by less than a predetermined amount the armature is determined to be at the zero lash point. If the armature is not at the lash point the routine returns to step 1005, otherwise the routine continues on to step 1011. Thus, when the location of the valve stem may not be known, the armature can be moved from an initial position in an incrementally controlled manner toward the valve stem.

Armature position may be determined in a variety of ways, none of which are intended to limit the scope or breadth of this description. For example, armature position may be determined by linear variable displacement transducers, binary position sensors, coil current, or potentiometer devices. Furthermore, actuator coil current may also be determined in a variety of ways, none of which are intended to limit the scope of breadth of this description. For example, actuator current may be determined from a current coil through which actuator current travels, secondary resistive networks, or by current monitoring transistors.

By iteratively looping through steps 1005 and 1007, the routine searches for and determines the zero lash position. Consequently, the zero lash position may be determined and adjusted over a period of cylinder cycles. Furthermore, iteration may be disabled when the engine reaches engine operating temperature since valve growth is expected to be minimal after engine warm-up. Thus, valve lash can be adjusted and adapted as engine operating conditions vary. In addition, once the zero lash position is determined, the zero lash point or a position offset from the zero lash point may be used as the demand position.

In step 1011, valve current and position data can be stored. Since valve stem growth may occur during engine warm-up and since components of an assembly may vary due to manufacturing tolerances, the amount of valve lash may vary between individual valves. Therefore, this data is stored so that during subsequent valve lash adjustments the armature position where lash is reduced below a predetermined amount does not have to be relearned, but may be used as a pre-positioning command. In one example, for starting an engine that is up to temperature where less valve growth is expected, individually levitated valve armatures can be positioned to predetermined locations without relearning the zero lash armature positions. In another example, a cold engine can be restarted and the levitated valve armatures may be positioned to a different position than is mentioned above, thereby providing different armature levitation positions based on engine temperature, for example.

Armature levitation parameters (e.g., start of levitation location, valve opening location and duration, stop of levitation, armature levitation position during closed valve, and armature levitation position during open valve) are stored in non-volatile or alternatively in power backed volatile memory so that they may be accessed during engine operation, engine stopping, or engine starting. The parameters may be stored in functions, tables, or equations that can be indexed by using engine operating conditions (e.g., engine coolant temperature, engine cylinder head temperature, engine exhaust temperature, air charge temperature, time since start, or by a number of cylinder events).

In one embodiment the steps of FIG. 10 may be executed at various rates and/or intervals such that the armature may be repositioned, thereby adjusting the gap, during a cylinder cycle or over a number of subsequent cylinder cycles. In another embodiment, the steps of FIG. 10 may be executed at predetermined conditions, after a temperature of the engine changes by 5° C. for example.

After the armature position and current are stored the routine proceeds to exit.

Figure 10B:
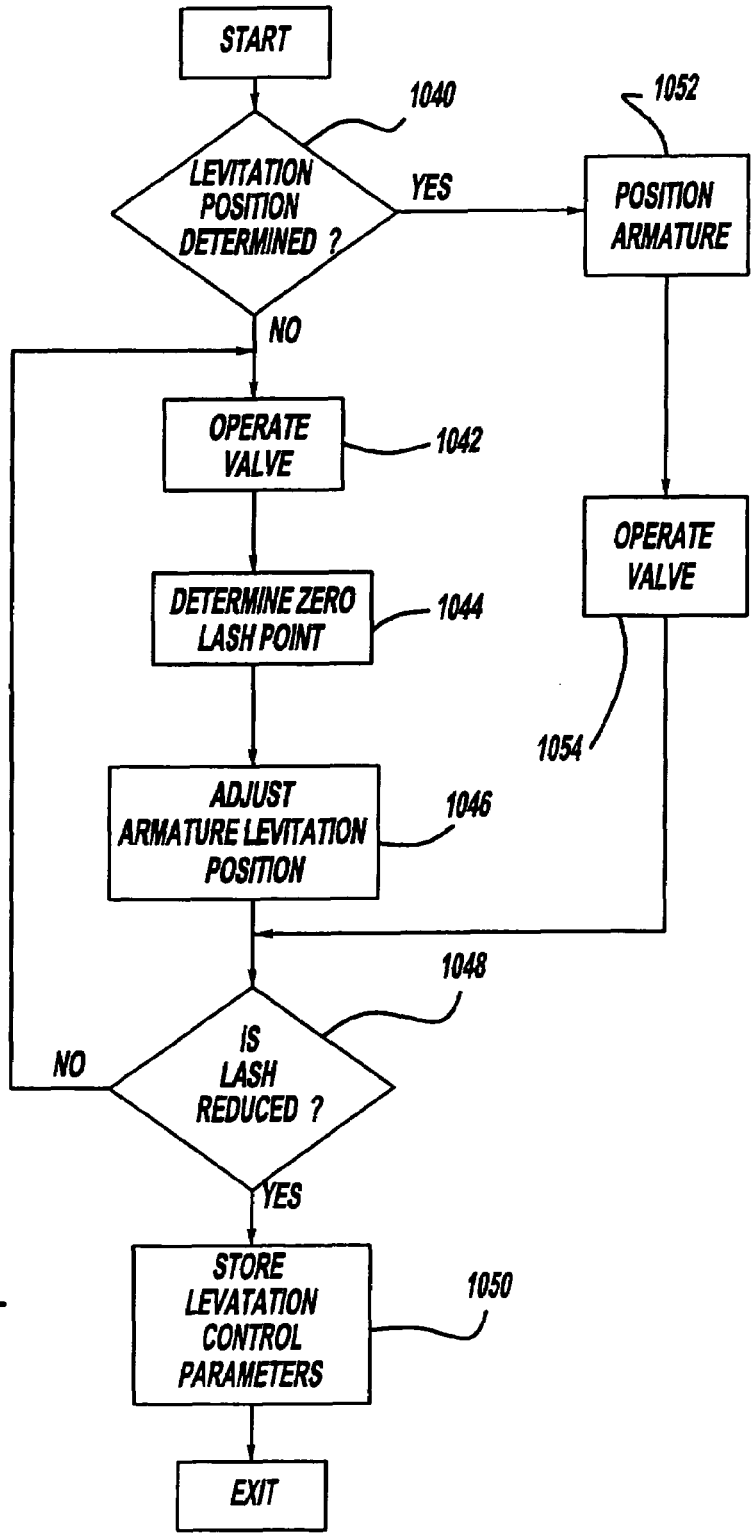
FIG. 10*b* is an alternative flow diagram showing a strategy for adjusting and adapting valve levitation position.

Referring to FIG. 10*b*, a flow diagram of an alternate method that may be used to control and determine an armature levitation position is shown. This method can find the zero lash point by monitoring or inferring valve position during a valve opening event and control armature position based on this position.

In step 1040, the routine determines if an initial levitation position location has been determined. That is, the routine determines if an armature position has been determined that reduces the valve lash between the armature and the valve stem. The lack or presence of stored data, from step 1050, can be used to determine the next step. If a predetermined levitation position is available, the routine proceeds to step 1052, if not, the routine proceeds to step 1042.

In step 1052, the routine positions the valve actuator armature. Armature data from the previous execution of the method of FIG. 10*b* is recalled from memory. The armature position may be regulated by the method of step 1012, of FIG. 10*a*, or alternatively, by another method. The routine then continues on to step 1054.

In step 1054, the routine monitors valve current and may monitor or infer valve position while observing a valve operating sequence (i.e., a valve opening or closing event). The valve may be commanded by an external routine that is based on engine air requirements or for other reasons, such as valve diagnostics. The routine proceeds to step 1048 after a valve operating sequence has occurred.

In step 1042, the routine monitors valve current and may monitor or infer valve position during a valve operating sequence. Again, the valve may be commanded by an external routine that is based on engine air requirements or for other reasons, such as valve diagnostics. The routine proceeds to step 1044 after a valve operating sequence has occurred.

In step 1044, the routine determines the zero lash point. As an electrically actuated valve opens from a closed position and returns to a closed position, characteristics of the valve actuator and valve may be determined. For example, by observing valve armature position, the zero lash point may be determined by evaluating the position rate of change (i.e., the actuator armature velocity). The zero lash point is the actuator armature position where the actuator armature velocity initially changes by more than a predetermined amount. Typically, the zero lash location is determined when by evaluating the actuator armature velocity during a predetermined crank angle interval, ±100 crank angle degrees from the expected valve opening position for example. The armature position where the armature velocity changes by more than a predetermined absolute value can be determined to be the zero lash point. Alternatively, the armature velocity rate of change (i.e., the change in armature velocity over a period of time) may be used to determine the zero lash point by comparing an observed rate of change in armature velocity to a predetermined value. If the observed rate of change in armature velocity exceeds a predetermined value, the armature location at the velocity excursion may be determined to be the zero lash point. See FIG. 12 for an illustration of the relationship between actuator armature position and actuator armature velocity. In this way, the valve lash point may be dynamically determined during regularly scheduled operating valve events. After the zero lash point is determined, the routine proceeds to step 1046.

In step 1046, the routine adjusts the armature levitation position. Using the zero lash point information determined from step 1044, the armature levitation position is determined. In one example, the levitation position may be determined by setting the valve levitation position at the zero lash point or at a predetermined offset from the zero lash point. Alternatively, the levitation position may be initially based on the zero lash point and then adjusted based on the armature velocity at the time of impact between the armature and the valve stem. In this way, the armature levitation position can be adjusted so that impact velocity between the armature and the valve stem is below a predetermined amount. The routine then continues to step 1048.

In step 1048, the routine determines if the valve lash has been reduced to a desired amount. As mentioned above, the valve lash may be determined by monitoring valve current and/or by monitoring valve position. In addition, the armature velocity at time of impact between the armature and the valve stem can also be used to determine if the lash has been reduced to a desired amount. For example, if the armature is being levitated at a desired position, but the armature velocity at time of impact is higher than desired, the levitation position may be adjusted to further reduce a gap that may exist between the armature and valve during levitation. If valve lash is greater than or less than desired, the routine proceeds to step 1042 and further adjusts the armature levitation position, otherwise the routine continues to step 1050.

In step 1050, the routine stores armature levitation control parameters for use at a subsequent time. As mentioned above, valve stem growth or contraction may occur during engine operation. Therefore, this data is stored so that during subsequent valve lash adjustments the lash amount does not have to be relearned, but may be used as a pre-positioning command. The routine then exits.

Figure 11:
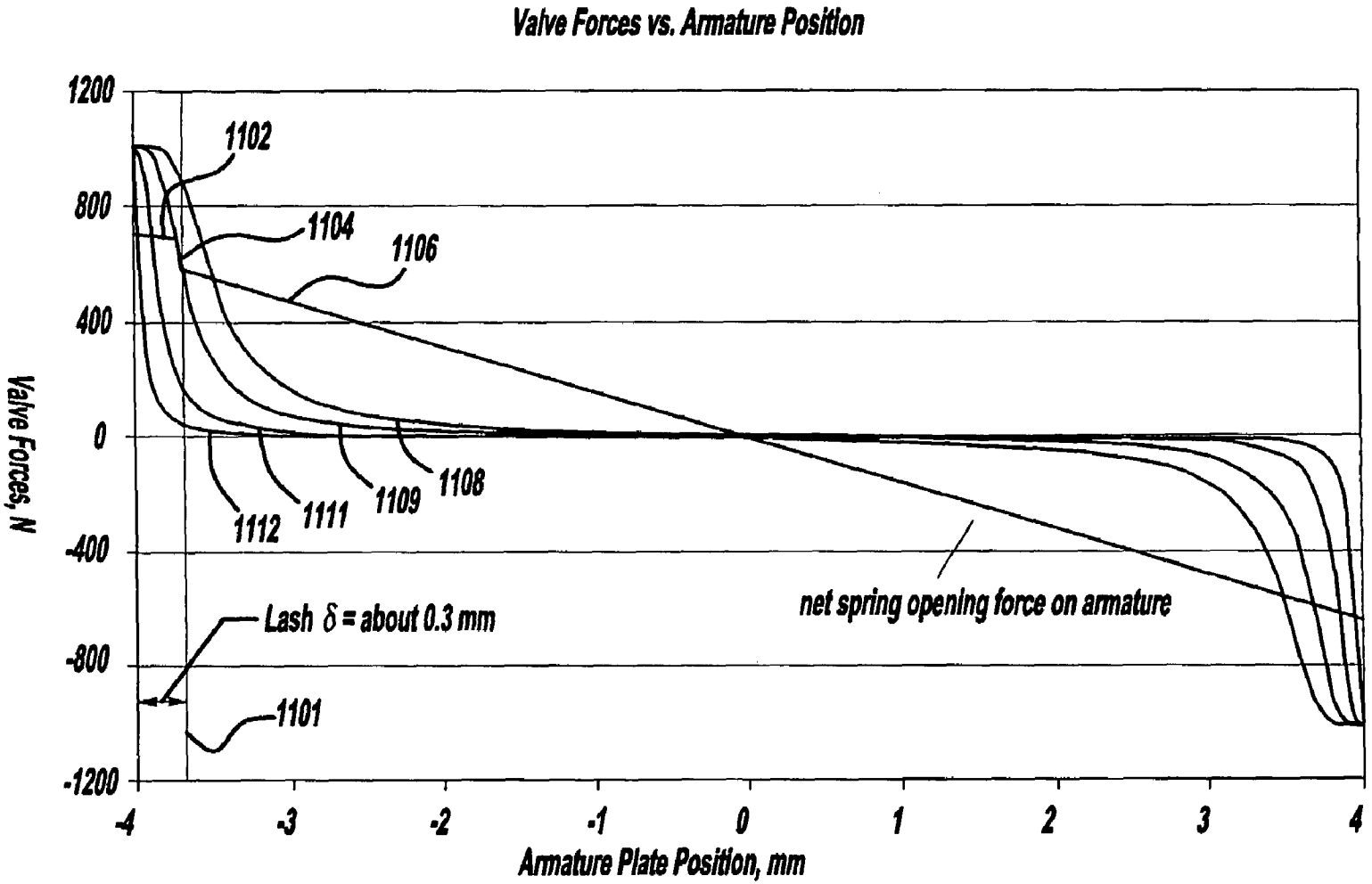
FIG. 11 is a plot of spring force acting on a valve actuator armature and of magnetic force acting on a valve actuator armature.

Referring to FIG. 11, an exemplary plot of spring force acting on a valve actuator armature and of magnetic force acting on a valve actuator armature are shown.

The x-axis represents the distance that a valve armature plate is away from the pole face of a magnetic closing coil and an opening coil for an armature similar to that shown in FIG. 2. Specifically, the x-axis begins at −4, a location that corresponds to the distance between the closing coil pole face and the location that is half way between the opening coil and closing coil pole faces. The x-axis ends at 4, a location that corresponds to the distance between the opening coil pole face and the location that is half way between the opening coil and closing coil pole faces. The x-axis zero represents the position where the armature plate is half way between the opening coil and closing coil pole faces.

The y-axis represents the force acting on the valve armature (magnetic and/or mechanical). The data plotted shows the relationship between armature position and forces acting on the armature.

The region of valve lash between the —4 x-axis position and the vertical lash line 1101 represents the amount of valve lash in between the valve actuator armature and the valve stem, 0.3 mm in this one example.

Curves 1108, 1109, 1111, and 1112 represent magnetic force acting on a non-permanent magnet armature as a function of armature plate distance from the respective coil pole faces at different levels of constant current. The figure indicates that the magnetic force increases as the armature plate approaches the pole face and is reduced as the armature plate approaches the zero position.

Starting from the left-hand side of the plot at the —4 position, the valve spring force curve 1106 follows a slope that is dependant on the spring constant of the valve opening spring 201 until the armature position where all the valve lash is completely or nearly completely removed (denoted by the near vertical line 1104). The increased rate of change in the spring force at location 1104 can be used as an indication that the actuator armature and the valve stem are in contact (i.e., the armature/opening spring system have been joined with the valve/closing spring system to produce a single spring/mass system). The rate of change in the spring force curve increases at 1104 because there is a preload on spring 211 that needs to be overcome before the armature/valve pair moves significantly. This force rate of change acting on the armature allows the zero lash point to be determined. The near vertical force line indicates that a small change in armature position relative to the more significant change total spring force. Since the electromagnetic force produced by current flow into an actuator coil is proportional to the square of the current amount, the change in current amount can be used to determine a change in force acting on the actuator armature. At the zero lash point a change in actuator coil current can move the force acting on the valve actuator up or down the vertical force line, segment 1104 of FIG. 11, where there is little movement in the actuator position. By monitoring the change in actuator current and the change in actuator position the zero lash point may be determined. For example, if the force acting on the actuator is moving in a direction from left to right of FIG. 11, and the force transitions from segment 1102 to segment 1104, a selected change in coil current will produce a small change in armature position. Thus, the relationship between actuator coil current and actuator armature position can be used to determine the zero lash point. After the spring preload is overcome, the spring force line then continues on through the remainder of the graph with a different slope that is dependant on the spring rates of both the opening and closing springs.

Figure 12:
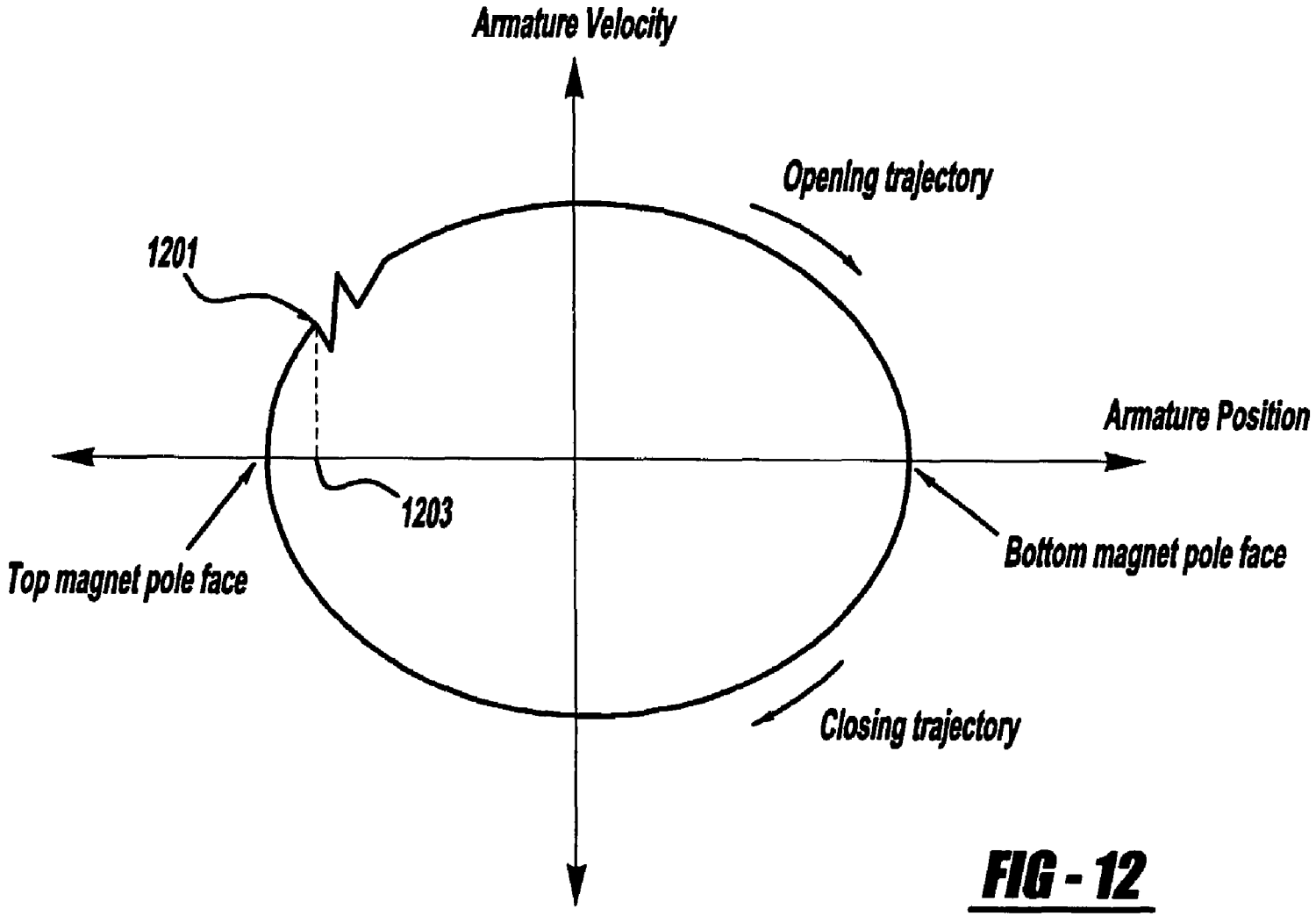
FIG. 12 is a plot of valve actuator armature velocity verses position during a valve opening and closing cycle.

Referring to FIG. 12, an electromagnetically actuated valve phase relationship plot is shown of a valve during an opening and closing cycle. The x-axis represents armature position and the y-axis represents armature velocity. Starting from the left-hand side of the figure, when an electromagnetically actuated valve is opened the armature moves toward the neutral position and increases in velocity. When the armature stem collides with the valve stem a noticeable change in valve armature velocity can occur, as indicated at 1201. The vertical line projected down from the impact point is used to graphically illustrate the location of impact, zero lash 1203, relative to the armature position. As the armature position continues along the opening trajectory path, additional damped impacts between the armature and valve stem may occur that are dependant on the spring mass system. These impacts may be ignored when determining the zero lash point since they can occur after the valve and have moved away from the zero lash point.

As will be appreciated by one of ordinary skill in the art, the routines described in FIGS. 9, 10*a*, and 10*b* may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

We claim:

1. A method to control the position of a valve actuator armature, with respect to a valve stem, for an electrically actuated valve, said electrically actuated valve operating in a cylinder of an internal combustion engine, the method comprising:

positioning a valve actuator armature in a first position such that said armature is in contact with a magnetic pole face during a first portion of a cylinder cycle;

positioning said valve actuator armature in a second position such that said armature is not in contact with said pole face while controlling a gap between said armature and said valve stem during a second portion of said cylinder cycle; and varying the engine position at which said valve actuator armature transitions from said first position to said second position as engine operating conditions vary.

2. The method of claim 1 wherein said second position of said armature is such that said electrically actuated valve is closed.

3. The method of claim 1 wherein said second position of said armature is such that said electrically actuated valve is open.

4. The method of claim 1 wherein said gap is variable and includes a distance of zero.

5. The method of claim 1 further comprising opening said electrically actuated valve at least once between subsequent cylinder cycles, and wherein said gap is a substantially constant value between said cycles while said electrically actuated valve is closed.

6. The method of claim 5 wherein said second position varies as an operating condition of said valve actuator varies during said opening of said electrically actuated valve.

7. The method of claim 6 wherein said valve actuator operating condition is a current amount supplied to at least a coil of said electrically actuated valve.

8. The method of claim 6 wherein said valve actuator operating condition is a position of said valve actuator armature.

9. A method for controlling a position of a valve actuator armature for an electrically actuated valve, the method comprising:

positioning said valve actuator armature at a first position such that said armature is in contact with a magnetic pole face during a first portion of a first cylinder cycle and positioning said valve actuator at a second position during a second portion of said first cylinder cycle such that said armature is not in contact with said magnetic pole face while controlling a gap between said armature and said valve stem, during a first set of engine operating conditions; and varying the time that said valve actuator armature operates at said first position and at said second position as engine operating conditions vary.

10. The method of claim 9 wherein at least one of said second position and said third position is stored in non-volatile random-access-memory.

11. The method of claim 9 wherein said first set of engine operating conditions include a temperature of an engine.

12. The method of claim 9 wherein at least one of said second position and said third position is stored in volatile random-access-memory.

13. A method for controlling the position of a valve actuator armature for an electrically actuated valve, the method comprising:

moving a valve actuator armature to a first position during a first period of a cylinder cycle, said actuator armature positioned such that said armature is in contact with a valve stem or a magnetic pole face;

moving said valve actuator armature to a second position during a second period of said cylinder cycle, where said armature is not in contact with a magnetic pole face, while controlling a gap between said armature and said valve stem, without opening said electrically actuated valve; and varying the engine position at which said valve actuator armature begins to operate at said first position as engine operating conditions vary.

14. The method of claim 13 wherein said second position is based on an operating condition of an engine.

15. The method of claim 14 wherein said operating condition of said engine is a temperature of said engine.

16. The method of claim 13 wherein at least one of said first and said second positions varies as a current amount supplied to said electrically actuated valve varies and as the position of said armature varies.

17. The method of claim 13 wherein said at least one of said first and said second positions is a zero lash position.

18. The method of claim 13 wherein at least one of said first position and said second positions is based, at least in part, on current supplied to at least a coil of a valve actuator during a prior valve opening or closing event.

19. A system for controlling the position of a valve actuator armature for an electrically actuated valve, said electrically actuated valve operating in a cylinder of an internal combustion engine, the system comprising:

an electrically actuated valve; and a controller for positioning said valve actuator armature such that said armature is in contact with a magnetic pole face during a first period of a cylinder cycle, and such that said armature is not in contact with a magnetic pole face for a second period of said cylinder cycle, and varying the engine position that a transition from said first period to said second period takes place as engine operating conditions vary.

20. A computer readable storage medium having stored data representing instructions executable by a computer to control an electrically actuated valve in a cylinder of an internal combustion engine of a vehicle, said storage medium comprising:

instructions for positioning said valve actuator armature such that said armature is not in contact with a magnetic pole face during a first period of a cylinder cycle, and such that said armature is not in contact with a magnetic pole face for a second period of said cylinder cycle, controlling a gap between said armature and said valve stem during said second period, and levitating said armature from said magnetic pole face at a location that is substantially coincident with an event of another cylinder of said engine.

* * * * *